United States Patent [19]

Gazda

[11] Patent Number: 4,842,064

[45] Date of Patent: Jun. 27, 1989

[54] WELL TESTING APPARATUS AND METHODS

[75] Inventor: Imre I. Gazda, Tarrant County, Tex.

[73] Assignee: Otis Engineering Corporation, Dallas, Tex.

[21] Appl. No.: 137,093

[22] Filed: Dec. 22, 1987

[51] Int. Cl.[4] ..... E21B 34/10; E21B 49/08

[52] U.S. Cl. ..... 166/250; 166/373 166/113; 166/332

[58] Field of Search ..... 166/250, 373, 65.1, 166/113, 125, 133, 332, 334, 331, 73

[56] References Cited

U.S. PATENT DOCUMENTS

| | | | |
|---|---|---|---|
| Re. 31,313 | 7/1983 | Fredd et al. | 166/250 |
| 3,664,427 | 5/1972 | Deaton | 166/313 |
| 4,051,897 | 10/1977 | Kingelin | 166/125 |
| 4,134,452 | 1/1979 | Kingelin | 166/133 |
| 4,149,593 | 4/1979 | Gazda et al. | 166/113 |
| 4,159,643 | 7/1979 | Watkins | 73/155 |
| 4,274,485 | 6/1981 | Fredd | 166/250 |
| 4,278,130 | 7/1981 | Evans et al. | 166/332 |
| 4,286,661 | 9/1981 | Gazda | 166/316 |
| 4,373,583 | 2/1983 | Waters | 166/113 |
| 4,420,044 | 12/1983 | Pullin et al. | 166/322 |
| 4,453,599 | 6/1984 | Fredd | 166/250 X |
| 4,473,122 | 9/1984 | Tamplen | 166/373 |
| 4,487,261 | 12/1984 | Gazda | 166/264 |
| 4,583,592 | 4/1986 | Gazda et al. | 166/250 |
| 4,625,799 | 12/1986 | McCormick et al. | 166/223 |
| 4,633,952 | 1/1987 | Ringgenberg | 166/336 |
| 4,669,537 | 6/1987 | Rambaugh | 166/113 |
| 4,678,035 | 7/1987 | Goldschild | 166/250 |

OTHER PUBLICATIONS

"Whats Happening in Drilling", World Oil, Oct. 1983; Muhleman, Jr.

*Primary Examiner*—William P. Neuder
*Attorney, Agent, or Firm*—Albert W. Carroll

[57] ABSTRACT

Well testing apparatus including a landing receptacle for placing in a well tubing, preferably near the well packer, and a well test tool lowerable with instrumentations into the tubing on a flexible line and anchorable in the landing receptacle, the test tool then being actuable between open and closed positions by tensioning and relaxing the flexible line to open and close the well at the downhole location so that well conditions therebelow can be determined, the test tool having a mechanism for propping the raisable portion of the test tool in its upper position automatically in response to raising it from its lower position, the prop mechanism being releasable only after the flexible line has been tensioned and relaxed a plurality of times to permit the raisable portion of the test tool to return to its lower position. Methods of testing wells through use of the claimed well testing apparatus are also disclosed.

23 Claims, 9 Drawing Sheets

WELL TESTING APPARATUS AND METHODS

BACKGROUND OF THE INVENTION

1. Field of the Invention

This application relates to well tools and more particularly to test tools which are run on a flexible line and are operated by tensioning and relaxing the same for opening the well for flow and for shutting it in at a downhole location, in order to gather well test data.

2. Description of the Prior Art

It has been common practice to shut in a producing well near its producing zone, thus to reduce the storage volume below the shut-in point so that pressure therein could approach stabilization with that of the producing formation much more quickly than could occur were the whole well bore pressurized. Likewise, when the well is re-opened to flow, the pressure in the well below the shut-in point reaches a point of stabilization more quickly. Well test data are commonly gathered both during build-up periods and draw-down periods.

Some tests require that the well be tested by a series of shut-in and flow periods during which test data are gathered.

Injectivity testing is commonly carried out in the case of injection wells. For such tests, injection of fluids into the reservoir is stabilized and the well is shut-in near the formation. The fall-off or reduction of pressure below the shut-in point is recorded, and after the fall-off has stabilized, the well may be opened up for another injection period. If desired, pressures may be observed and recorded during both the injection and the shut-in periods. The tests may involve any number of injection and shut-in periods.

Subsequent to such tests, the data gathered are analyzed to determine various characteristics of the reservoir.

Test tools for carrying out well tests have generally been run on a flexible line, that is, a wire line ("slick line") or an electrical cable. Many of the test tools either include a valve or are associated with a valve and are so related that the test tool, after being anchored in a receptacle, is used to operate the valve between open and closed position by tensioning and relaxing the slick line or electrical cable. Other tools may operate in the opposite manner, being actuated to the open position in response to tensioning the flexible line. Usually, the test tool is lowered into the well, its lower end portion anchored in a receptacle, and the flexible line then tensioned to close the valve and thus shut-in the well, and the flexibile line is afterwards relaxed to open the valve and allow the well to flow. If an electrical cable is used, the tool string will usually include sensor means for sensing pressure below the valve and sending appropriate electrical signals to the surface for readout and/or display and storage. Of course an electronic memory gage can be used, but in such case the memory cannot be unloaded until the test tool is withdrawn from the well.

A slick line can be used to run a test tool and a battery-powered memory gage into a well. And a slick line can also be used to run a test tool into the well with a mechanical recording gage. In this case, the chart made by the gage is read after the test tool is withdrawn from the well.

The relaxing of the flexible line does not pose a problem, since when the line tension is reduced sufficiently, the movable portion of the test tool moves down, but it is readily understandable that tensioning of the flexible line will pose a considerable problem if such tests are to be carried out on offshore wells, for instance.

The problem arises due to the fact that the offshore well is anchored in the earth and therefore stands still in the water while the surface craft supporting the flexible line reel rises and falls in response to the waves on the surface of the water and may also be buffeted by the wind. Under such circumstances, it is at best extremely difficult to hold proper tension on a test tool to maintain it in the up mode, whether that be the test tool's open or closed position.

It is desirable to have the ability to slack the flexible line not only when the test tool is in its "down mode" but also when it is in its "up mode" so that the motion of the surface craft due to wave action will not affect operation of the test tool in the well. Thus, much time and money can be saved by eliminating erroneous and/or incomplete surveys.

Further, it is desirable to provide a test tool of the nature discussed above, but which is ideally suited for carrying out tests in wells, especially offshore wells, since the nature of the tool permits the flexible line to be slacked as much as desired whether the tool is open or closed.

Applicant is familiar with the following prior patents which relate to the subject matter which relates to the present invention. These prior patents are:

| | | |
|---|---|---|
| Re.31,313 | 3,664,427 | 4,051,897 |
| 4,134,452 | 4,149,593 | 4,159,643 |
| 4,274,485 | 4,278,130 | 4,286,661 |
| 4,373,583 | 4,420,044 | 4,487,261 |
| 4,583,592 | 4,625,799 | 4,669,537 |
| 4,678,035 | | |

Applicant is familiar also with a brochure published by Flopetrol-Johnston covering their MUST Universal DST device, and with an editorial comment published in WORLD OIL magazine, page 21, October 1983 Edition.

In addition, Applicant is familiar with U. S. Pat. Nos. 4,051,897 issued to George F. Kingelin on Oct. 4, 1977; 4,134,452 issued to George F. Kingelin on Jan. 16, 1979; 4,149,593 issued to Imre I. Gazda, et al. on Apr. 17, 1979; 4,159,643 issued to Fred E. Watkins on July 3, 1979; 4,286,661 issued on Sept. 1, 1981 to Imre I. Gazda; 4,373,583 issued Feb. 15, 1983 to Fleming A. Waters; U.S. Pat. No. Re. 31,313 issued July 19, 1983 to John V. Fredd and Phillip S. Sizer, on reissue of their original U.S. Pat. No. 4,274,485 which issued on June 23, 1981; and U.S. Pat. No. 4,278,130 issued July 14, 1981 to Robert T. Evans, et al, all of which disclose test tools which may be run on a wire line or cable and used to open and close as well at a downhole location by pulling up or slacking off on the wire line or cable by which these test tools are lowered into the well. In each of the above cases, a receptacle device is first run on a wire line and anchored in a landing nipple, then a probe-like device is run and latched into the receptacle.

U. S. Pat. No. 4,051,897 issued to George F. Kingelin on Oct. 4, 1977 and discloses an early type of well test tool for running on a flexible line and anchoring and sealing in a receptacle located downhole in a well whereby the well can be controlled at such downhole location by tensioning and relaxing the flexible line to open the well to flow and to shut it in to stop flow so that well pressures could be determined below the test tool both during the flow period and during the shut-in period. The problem with this test tool was that its flow capacity was very small (too small for suitable flow tests and was used for equalizing pressures across the tool so that it could be safely removed from its anchored position). The present invention is an improvement over the device of U.S. Pat. No. 4,051,897.

U.S. Pat. No. 4,134,452 provides only a tiny flow passage therethrough openable and closable by tensioning and relaxing the conductor cable for equalizing pressures across the tool.

U.S. Pat. No. 4,149,593 is an improvement over the device of U.S. Pat. No. 4,134,452 and provides a much greater flow capacity as well as a locking sub which locks the tool in the receptacle with a tenacity somewhat proportional to the differential pressure acting thereacross.

U.S. Pat. No. 4,286,661 is a divison of U. S. Pat. No. 4,149,593, just discussed, and discloses an equalizing valve for equalizing pressures across the device disclosed in U.S. Pat. No. 4,149,593.

U.S. Pat. No. 4,159,643 discloses a device similar to those mentioned above and has a relatively small flow capacity. This tool has lateral inlet ports which are closed by tensioning the conductor cable.

U.S. Pat. No. 4,373,583 discloses a test tool similar to those just discussed. It carries a self-contained recording pressure gage suspended from its lower end and therefore sends no well data to the surface during the testing of a well. This tool, therefore, may be run on a conventional wire line rather than a conductor line, since it requires no electrical energy for its operation.

U.S. Pat. No. Re. 31,313 discloses a device similar to that of U.S. Pat. No. 4,373,583 in that it has lateral inlet ports which are opened and closed by moving a probe up or down through tensioning or relaxing the wire line or cable on which it is lowered into the well.

U.S. Pat. No. 4,487,261 issued to Imre I. Gazda on Dec. 11, 1984 and discloses a well test tool which is an improvement over the well test tool of U.S. Pat. Nos. 4,051,897; 4,134,452; 4,149,593; and 4,286,661. This improved test tool has a much increased flow capacity made possible by placing the landing receptacle in the well tubing string as a portion thereof but could only be retrieved by retrieving the tubing.

U.S. Pat. No. 4,583,592 issued to Imre I. Gazda and Phillip S. Sizer on Apr. 22, 1986. This test tool is similar to the test tool of U.S. Pat. No. 4,487,261 but lands in a landing receptacle which forms a movable part of a bypass assembly. Tensioning the flexible line not only closes the test tool but also closes the bypass passages of the bypass assembly. The test tool releases from its anchored position after a predetermined number of open/close cycles. The flow capacity can easily be as large as the flow capacity of the tubing with which it is used.

U.S. Pat. No. 4,669,537 issued to William D. Rumbaugh on June 2, 1987 and discloses a well test tool utilizing a lock device having a sliding sleeve valve thereon, the lock device for anchoring and sealing in a landing nipple downhole. The running tool used to install the test tool is also used to open and close the sleeve valve. Any number of cycles may be had. On the last cycle the sleeve valve is left closed as the running tool is separated therefrom. A pulling tool is then run to equalize pressures across the test tool and to then unlock and retrieve it from the well.

U.S. Pat. No. 4,678,035 which issued to Pierre Goldschild on July 7, 1987, together with the MUST brochure and the WORLD OIL article, disclose the drill stem test tool having a non-retrievable valve opened and closed from the surface by tensioning and relaxing the conductor cable connected to the probe-like tool latched into the valve. Even with the valve open and the well producing, no flow takes place through the probe. All flow moves outward through the side of the valve into a bypass passage which then empties back into the tubing at a location near but somewhat below the upper end of the probe. The probe automatically releases when a predetermined number (up to twelve) of open-close cycles have been performed.

U.S. Pat. No. 3,664,427 which issued to Thomas M. Deaton on May 23, 1972 and U.S. Pat. No. 4,420,044 which issued to William H. Pullin on Dec. 13, 1983 show tools which utilize a type of zig-zag slot and pin arrangement for controlling relative longitudinal movement between two relatively slidable parts and providing alternate long and short strokes. U. S. Pat. No. 4,625,799 which issued to William H. McCormick and Charles C. Cobb on Dec. 2, 1986 shows use of a continuous zig-zag slot to cause relative rotational movement in response to relative longitudinal movement between two relatively slidable parts.

All of the U. S. patents listed and discussed above are incorporated herein by reference thereto for all purposes.

There is not found in the prior art known to Applicant a test tool for opening-up a well and shutting-in a well at a downhole location by tensioning and relaxing the flexible line by which such test tool is lowered into the well, wherein such test tool can be caused to remain in its upper position while the flexible line is slacked off as would be convenient to do to allow for movement of a surface craft relative to an offshore well.

SUMMARY OF THE INVENTION

The present invention is directed to test tools and landing receptacles therefor, said test tools having body members which are relatively slidable longitudinally for opening-up the well to flow at a downhole location and shutting-in the well to stop flow by anchoring one part of the test tool in a landing receptacle and then tensioning and relaxing the flexible line on which the test tool is lowered into the well, the test tool including means for holding said test tool in its upper position so that the flexible line can be slacked to allow for relative movement between said well and the flexible line reel.

It is therefore one object of this invention to provide a well test tool and landing receptacle therefor, said test tool being operable between open and closed positions by raising and lowering a portion thereof relative to another portion thereof which is anchored in the well, the test tool having means therein for holding the raisable portion of the tool in its raised position.

Another object is to provide such a test tool with such holding means which becomes engaged automatically when the raisable portion thereof is raised to its upper position.

Another object is to provide such a test tool having such holding means which after the raisable portion has been raised and held in its raised position must then be lifted slightly a plurality of times before it can be lowered to its lower position.

Another object is to provide a well test tool having a larger flow capacity.

Another object is to provide a test tool of the character described having a main valve and an equalizing valve to provide large flow capacity and requiring minimal operation forces.

Another object is to provide an improved landing receptacle for anchoring the test tool in the well, the receptacle having anchoring lugs for engaging in an annular upwardly facing shoulder on the test tool, the lugs moving between engaging and releasing positions in a plane normal to the longitudinal axis of the receptacle.

Another object is to provide a landing receptacle for anchoring a test tool therein, the landing receptacle having a piston therein for utilizing the well pressure to aid in anchoring the test tool with increased force in response to an increase in differential pressure acting across the piston thereof.

Another object is to provide such landing receptacle with an increased inside diameter, thus making it possible to provide a test tool with increased flow capacity.

Another object is to provide a test tool of the character described which can be run in conjunction with pressure sensor means and having a flow passage therein for conducting well pressure from below its valve to the pressure sensing means all the while the test tool is anchored in the landing receptacle in the well.

Another object is to provide such a landing receptacle for anchoring a test tool in a well such that the test tool may be unanchored by a straight upward pulling force applied thereto and which can be immediately anchored in the landing receptacle again any number of times, if desired, for further testing and recycling.

Another object is to provide methods for testing wells through use of the test tools and landing receptacles of the present invention.

Other objects and advantages of this invention will become apparent from reading the description which follows and from studying the accompanying drawings, wherein:

DESCRIPTION OF THE PREFERRED EMBODIMENTS

Figure 1:
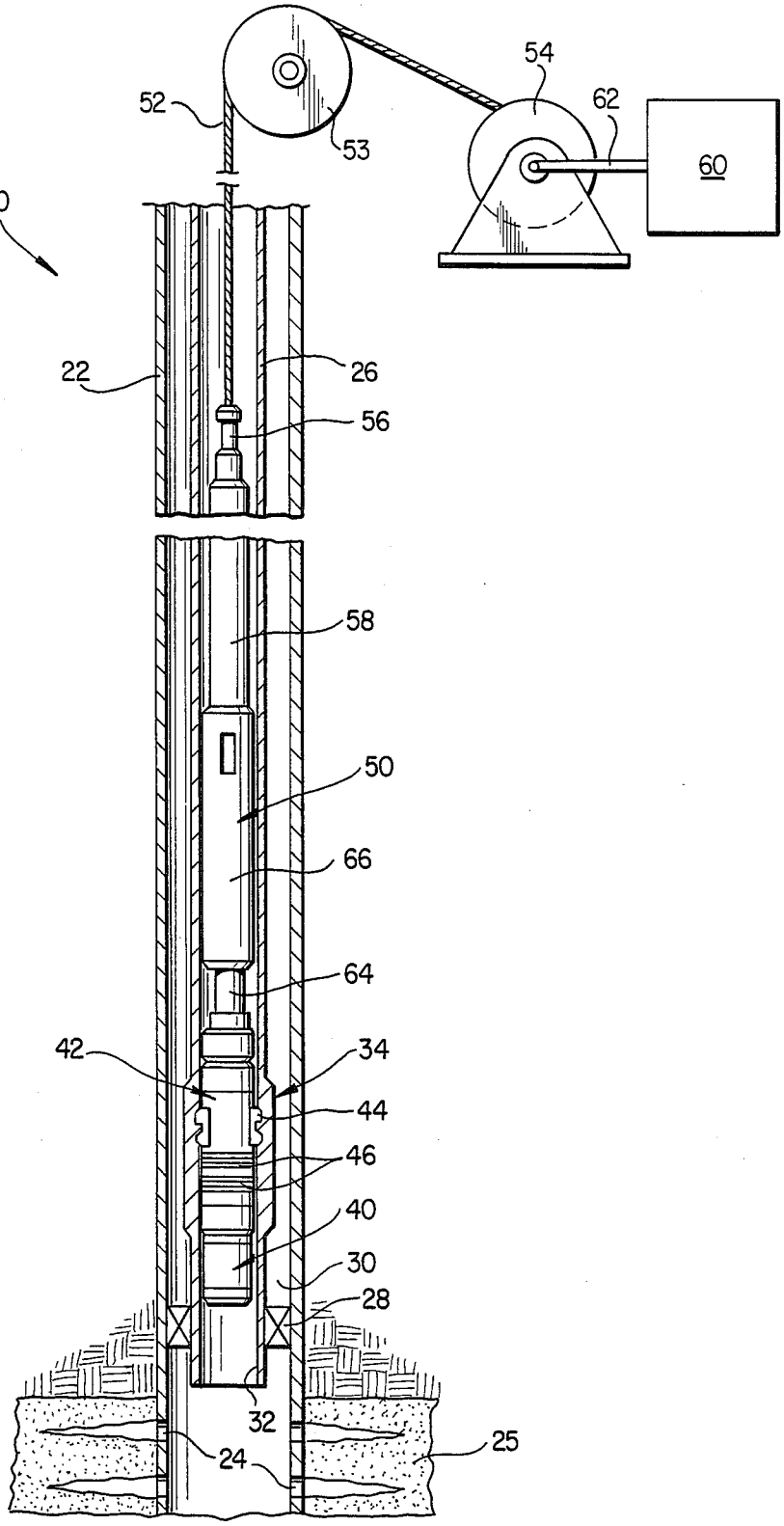
FIG. 1 is a schematical view of a well being tested with the apparatus of this invention.

Referring now to FIG. 1, it will be seen that the well 20 includes a casing 22 which is perforated as at 24 opposite an earth formation 25, such as a hydrocarbon bearing reservoir.

A tubing 26 is disposed within the casing 22 and a packer 28 seals the annulus 30 between the tubing and the casing at a location above the perforations 24.

Fluids from the formation 25 flow through the perforations 24 into the casing below the packer 28 and proceed upwardly through the bore 32 of the tubing to the surface (not shown).

The tubing 26 includes a landing nipple 34 located above but preferably near the packer 28. A landing receptacle 40 is supported on the lower end of a locking device 42 which has its lock keys 44 lockingly engaged in the corresponding lock recesses of the landing nipple 34 while its seal rings 46 are sealingly engaged with a smooth bore section of the landing nipple, thus forcing any fluid flow to pass through the internal passage through the locking device.

A test tool 50 has been lowered into the tubing 26 on a flexible line 52, in this case an electrical cable, which passes over the sheave 53 to the reel 54. The reel is driven by means not shown to both lower the test tool into the well and to withdraw it therefrom.

The cable 52 is connected via rope socket 56 to the upper end of a transducer section 58 containing a pressure transducer which senses well pressure and generates appropriate signals corresponding thereto which are transmitted via the cable to the reel and further to the surface readout (SRO) equipment 60 through electrical conduit 62.

The test tool is provided with a flow passage for continually conducting well pressure from below the test tool to the pressure sensor above the test tool all the while that the test tool is anchored in the landing receptacle.

The test tool, as shown, has its mandrel 64 anchored in the landing receptacle. The housing 66 of the test tool is telescoped over the mandrel and is movable up and down relative thereto between open and closed positions for permitting and preventing fluid flow through the test tool. One form of the test tool may be closed when the housing is in its upper position (and this would usually be true if the well was a producing well). The form of test tool to be described is that of an injection test tool for performing injectivity type tests in injection wells. Therefore, the test tool 50 will be open to permit fluid flow therethrough when the housing 66 thereof is raised to its upper position as by tensioning the cable 52. The test tool is closed by allowing the housing 66 to be lowered to its lower position by relaxing the flexible line. However, the test tool 50 is provided with means on the housing 66 and the mandrel 64 coengageable to hold the housing in its upper position. So, slacking the line will not, at this time, allow the housing to move to its lower position. Before this can happen, the flexible line must be tensioned and relaxed a plurality of times, as will be later explained.

Figure 2A:
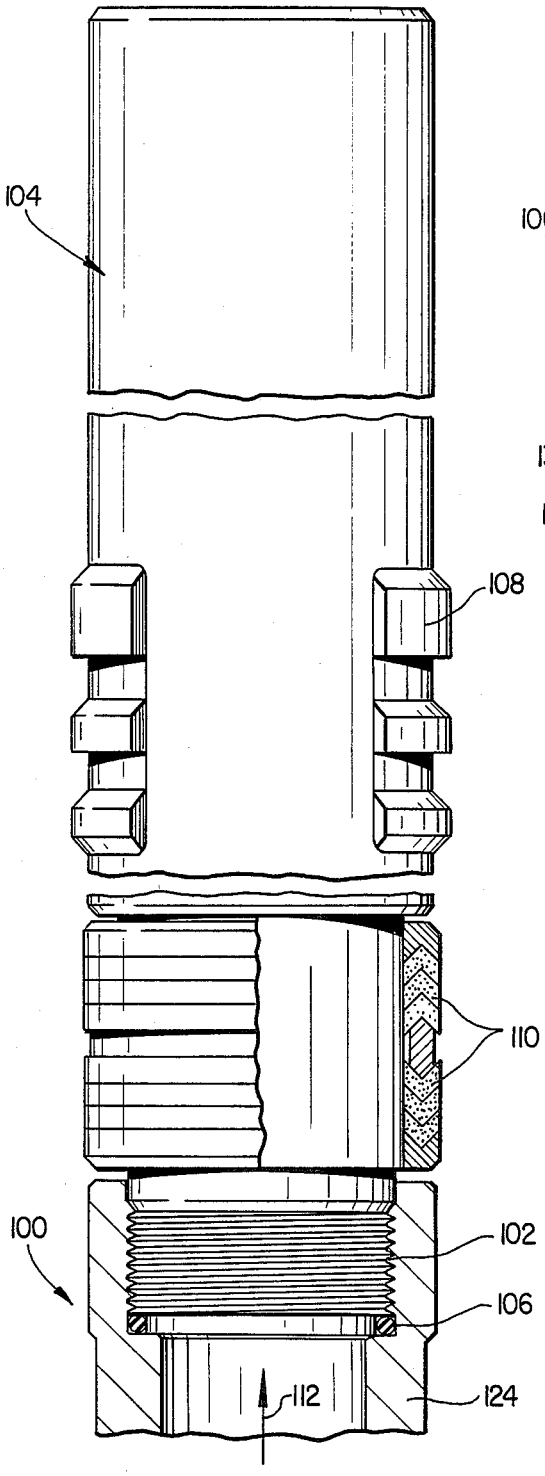
FIGS. 2A and 2B, taken together, constitute a view partly in elevation and partly in section showing a landing receptacle of the present invention attached to the lower end of a wireline removable locking device which may be installed in a suitable landing nipple in a well.
Figure 2B:
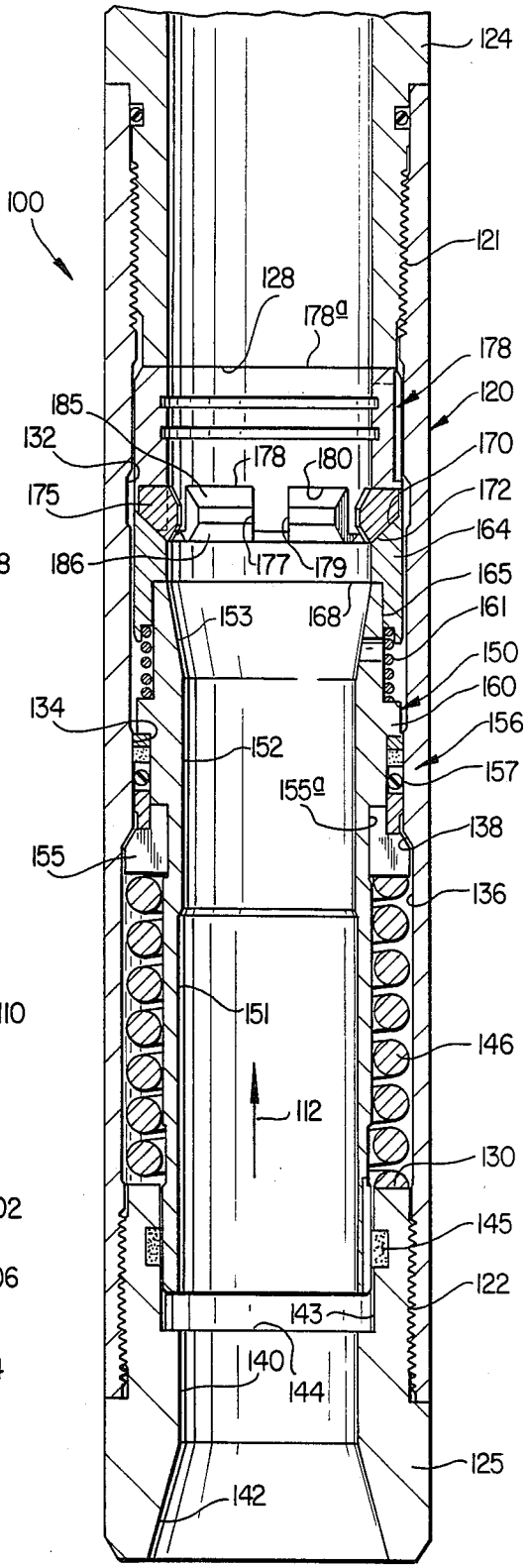

Referring now to FIGS. 2A–2B, it will be seen that the landing receptacle 100, which is represented in FIG. 1 by the reference numeral 40, is attached as by thread 102 to the locking device 104, the connection being sealed by seal ring 106.

Locking device 104 may be any suitable locking device capable of anchoring the test tool in the well flow conductor in sealed relation therewith. Preferably a locking device which locks and seals in a landing nipple should be used but must be intended for use with the landing nipple in the well. (Suitable landing nipples and locking devices are available from Otis Engineering Corporation, Dallas, Tex. 75234.) Landing receptacle 100 and locking device 104 are run into the well on a wire line and tool string including a suitable running tool in the well-known manner. The locking device is installed in the landing nipple, such as landing nipple 34, for instance, with its locking keys 108 engaged in the corresponding internal lock recesses and with its seal rings 110 sealingly engaging the smooth bore of the landing nipple. All flow moving upwardly through the tubing must necessarily flow through the central flow passage through the landing receptacle. This flow passage is indicated by the arrow 112 in FIGS. 2A–2B.

The landing receptacle includes a housing 120 threaded at its upper and lower ends, as at 121 and 122, to receive the upper and lower subs 124 and 125, respectively, as shown. The upper sub 124 provides a downwardly facing shoulder 128 in the housing while the lower sub 125 similarly provides an upwardly facing shoulder 130. Between these oppositely facing shoulders 128 and 130, the housing is provided with an internal annular recess 132, a slightly reduced smooth bore portion 134 and an enlarged bore 136 therebelow providing a stop shoulder 138 which is inclined downwardly and outwardly.

The lower sub 125 has a bore 140 which is flared downwardly as at 142, and has its upper portion enlarged as at 143, providing a stop shoulder 144. Bore 143 has an internal annular recess formed in its wall which carries a bushing 145 preferably formed of a low friction non-ferrous material, such as TEFLON, for example. A large coil spring 146 has its lower end resting upon the upper end 130 of upper sub 125.

A tubular piston 150 is disposed inside housing 120 and has a central bore 151 which has a smooth bore portion 152 which is slightly reduced and is flared upwardly as at 153 as shown.

The coil spring 146 has its upper end pressing upwardly against split ring 155 carried in a suitable external recess **155*a* formed in the piston, to bias the piston 150 upwardly in the housing for a purpose soon to be disclosed. The split ring 155 supports seal assembly 156, including an o-ring 157 and suitable back-up rings, as shown, for sealing between the piston and the smooth bore 134 of the housing. The seal assembly 156 is confined beneath external flange 160 on the piston while small, spring 161 is supported by the upper side of flange 160. A cam sleeve 164 is telescoped over tne upper reduced end portion 165 of piston 150 and is engaged with the upper end of spring 161** which biases the cam sleeve upwardly relative to the piston.

Figure 3:
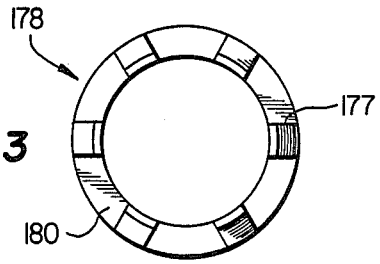
FIG. 3 is a bottom view of the anchor lug cage of the landing receptacle of FIGS. 2A–2B.
Figure 4:
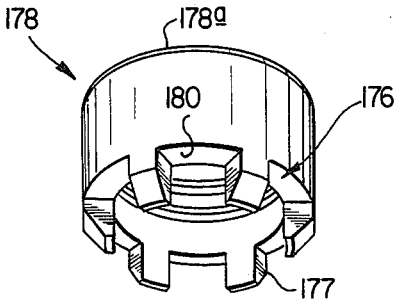
FIG. 4 is a perspective view of the anchor lug cage shown in FIG. 3.

The cam sleeve 164, which is seen also in FIGS. 3 and 4, is biased upwardly by the piston 150 somewhat as taught in U.S. Pat. Nos. 4,149,593; 4,286,661; and 4,487,261; and also by small spring 161, is formed with a downwardly facing stop shoulder 168 which engages the upper end of the piston, and with a cam surface 170 which is inclined upwardly and outwardly as shown. This cam surface 170 engages a corresponding cam surface 172 of each of a plurality of anchor lugs 175, each of which is mounted in a downwardly opening slot 176 of the lug cage 178 for radial movement therein. Lug cage 178 has its upper end **178*a* abutted against the lower end 128 of top sub 124. Lug cage 178 can, if desired, be formed integral with upper sub 124, but preferably is formed separately, as shown, so that it is readily replaceable and can also be formed of a different material. Both the slots 176 and the anchor lugs 175 are formed with their lateral sides 177 and 179, respectively, directed radially and the anchor lugs are sized so that their inward movement is limited by engagement of their lateral sides with the sides of the slots. (See FIGS. 3 and 4**.)

The anchor lugs 175 when in their inner position project into the central bore of the landing receptacle, as shown, but are movable outwardly to an outer position wherein they do not project into the central bore of the landing receptacle. The upper planar end face 178 of each lug engages a corresponding planar surface 180 which forms the root of the downwardly facing slots 176. These planar surfaces are in a plane which is perpendicular to the longitudinal axis of the landing receptacle.

Thus, as the lugs move outwardly, their inclined surfaces 172 cam the cam sleeve 164 and piston 150 downward, but when the cam sleeve moves upwardly, its inclined surface 170 thereof cams the lugs inwardly. Since the upper planar surface 178 of each lug remains in sliding contact with the downwardly facing planar surface 180 of the slot, the lugs do not move longitudinally of the landing receptacle as they move radially between their inner and outer positions.

The landing receptacle 100 can be used on locking devices of sizes and types different from locking device 104 seen in FIG. 2A. The thread 102 of the top sub 124 must be compatible with the thread 102 on the lower end of the locking device with which it is to be used. Interchangeable top subs having suitable threads at their upper ends can be used to replace upper sub 124 of FIG. 2A–2B, as necessary. In this way, the test tool can be used in various szzes of well tubing.

When the upper sub 124 is unscrewed from its normal position, the large coil spring 146 will force the piston 150, the seal assembly 156, the cam sleeve 164, and lug cage 178 upwardly, together with the anchor lugs, but for only a very short distance until the split ring 155 of the piston is stopped by the downwardly facing stop shoulder 138 of the housing. Thus, the seal assembly cannot move beyond the smooth bore but must remain therein.

The landing receptacle receives the lower end of the test tool and anchors it in place. The lower end of the test tool, as it is lowered into the receptacle, engages the upwardly facing cam surface 185 on the anchor lugs and cams them to their outer positions in which they extend outwardly into recess 132 of the housing 120, then the lugs return to their inner positions above an upwardly facing shoulder on the test tool. The test tool is disengaged from the landing receptacle by a straight upward pull without jarring. The upwardly facing shoulder on the test tool engages downwardly facing cam surface 186 on the anchor lugs as the test tool moves upward and cams them to their outer positions to permit withdrawal of the test tool.

Well test tools of the type relating to the present invention may vary somewhat in structure, but since they are operated by tensioning and relaxing the flexible line by which they are lowered into the well, they are generally of two types: those which are opened in response to slacking the flexible line, as in U.S. Pat. Nos. Re. 31,313; 4,274,485; 4,487,261; and 4,583,592, for instance, and those which are closed in response to slacking the flexible line, as in U.S. Pat. Nos. 4,051,897; 4,134,452; and 4,149,593, for example. Generally, such test tools include telescoped members which are relatively slidable and tensioning of the flexible line raises one of these members relative to the other, and relaxing the flexible line allows the raised member to be lowered.

Figure 5:
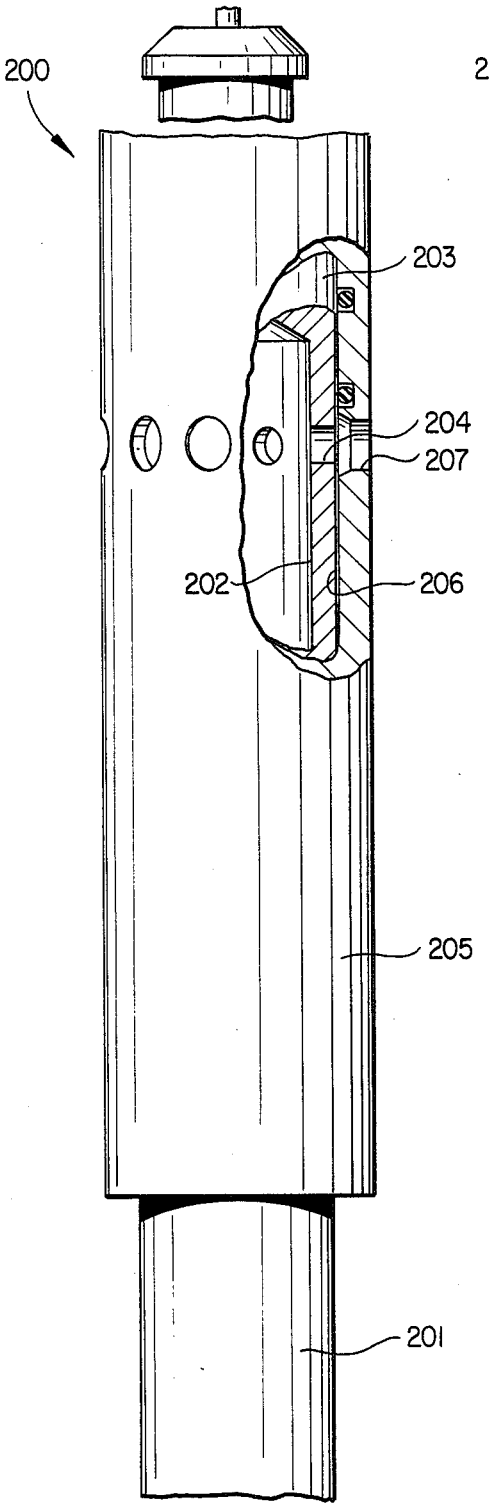
FIG. 5 is a fragmentary schematical view of a test tool of the type which will permit fluid flow therethrough when the housing portion thereof is in its upper position relative to the anchored portion.

Referring to FIG. 5, it is seen that the test tool 200 includes a tubular mandrel 201 having a bore 202 closed as at 203 at its upper end, and has a lateral port 204. A tubular housing 205 having a bore 206 is telescoped over the upper end of the mandrel 201 and is slidable thereon. The housing 205 is shown in its upper position, and in this position the housing port 207 is clearly aligned with the mandrel port 204 and the test tool may be said to be open, since fluid flow can take place therethrough. Since these two ported sleeves, mandrel 201 and housing 205, cooperate together to permit or prohibit fluid flow therethrough, they constitute a sleeve type valve. The valve shown in FIG. 5 is opened by tensioning the flexible line to raise the housing to its upper position and is closed by relaxing the flexible line to lower the housing to its lower position.

Figure 6:
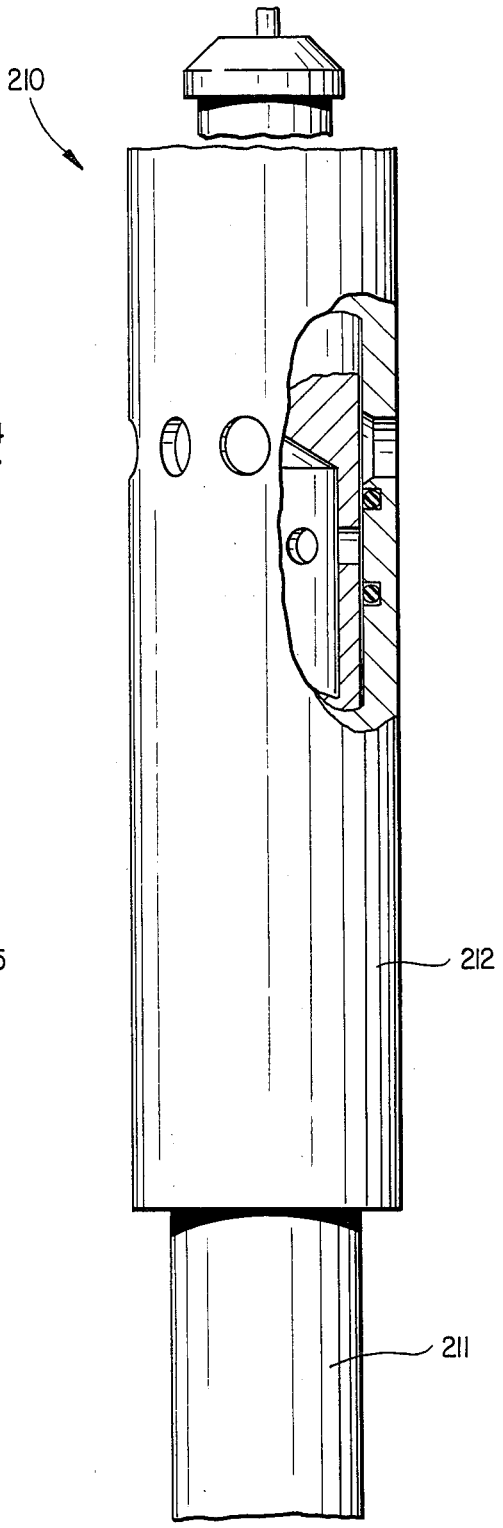
FIG. 6 is a view similar to that of FIG. 5, but showing a test tool which will not permit fluid flow therethrough when the housing thereof is in its upper position.

Referring now to FIG. 6, it will be seen that the test tool 210 includes a tubular mandrel 211 over which is telescoped a housing 212 for sliding movement thereon. The housing is shown in its upper position and the valve is closed. The valve is opened by relaxing the flexible line to lower the housing to its lower position. The valve is closed by tensioning the flexible line to raise the housing to its upper position.

A test tool embodying the present invention is illustrated in FIGS. 7A–7F where it is indicated generally by the reference numeral 300. This test tool is similar to test tool 200 of FIG. 5 in that it is open when the housing is in its upper position upon the mandrel. It is particularly suited for carrying out testing operations in injection wells. This test tool forms a part of a tool string 302 which includes a rope socket 304 attached to a suitable weight bar or bars 306 to the lower end of which is attached suitable instrument means or transducer means 307 for sensing pressure and/or temperature, for instance, attached as by thread 308 to the adapter 310 on the upper end of test tool 300, as shown. Adapter 310 may contain fluid barrier means to prevent well fluids from entering and damaging the transducer means. Adapter 310 is internally threaded as at 314 for attachment to the upper end of prong 316 which has a blind fluid passage 317 extending almost the full length thereof. Thread 314 is sealed by seal ring 318*a*. Prong 316 has its reduced upper end portion extending upwardly through a thimble 318 having an external flange 320. A shear pin 321 releasably secures the thimble in the bore 324 of the fishing neck 325 while the enlarged portion of the prong 316 provides an upwardly facing shoulder 327 which would otherwise abut the lower end of the thimble 318 to prevent withdrawal of the prong from the fishing neck 326. It is desirable to include a resilient ring such as the o-ring 328 to absorb upward shock forces and prevent shearing of the pin 321 prematurely. Also, it is desirable to place shock absorbing means between the upper end of the thimble 318 and the lower end 329 of adapter 310. As shown, the thimble 318 has the upper portion of its bore enlarged to form a recess to receive two resilient rings such as o-rings 322 separated by a spacer ring 323. If the lower end 329 of the adapter 310 is left with a flat face, then the recess at the upper end of the thimble should be only approximately deep enough to house one o-ring 322 and the spacer 323. Thus, the lower end of the adapter 310 stands off from the thimble and if these two members are forced toward one another, the o-rings will absorb much of the force and prevent premature shearing of the shear pin 321. Should the shear pin be subjected to excessive upward loads, it will shear and the prong and thimble will be withdrawn from the fishing neck which leaves the upper end of the fishing neck clear for engagement of a fishing tool which will be run into the well later to engage the fishing flange 330 in the well-known manner for retrieving the test tool.

Figure 8:
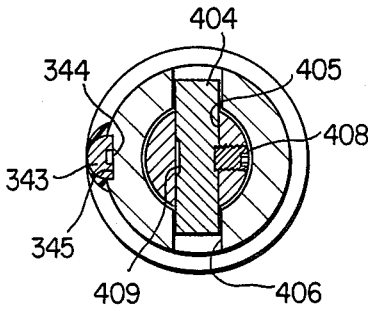
FIG. 8 is a cross-sectional view taken along line 8—8 of FIG. 7C.

The lower end of the fishing neck is attached as by thread 332 to the upper end of upper housing member 335 of the test tool and the prong 316 has its lower end disposed in bore 336 of the upper housing member with its two spaced apart seal rings 337 sealing above and below lateral passage 338 which has its inward end fluidly communicating with lateral passage 339 of the prong which connects with the central passage 317 as shown. The outward end of lateral passage 338 connects to laterally offset longitudinal passage 340 which leads downward to lateral passage 342. Passage 340 is provided by a bar 343 (see FIG. 8) having a groove 344 and welded in place on a suitable longitudinal flat surface such as flat surface 345 on the body, as shown. Flat surface 345 is preferably the bottom of a shallow groove, as shown.

The housing assembly 337 of the test tool 300 may be considered to comprise the fishing neck 316, upper housing member 335, and lower housing 355. Lower housing 355 comprises main housing member 360 and skirt member 362.

Upper housing member 335 is tubular, having a central bore running its full length. The bore is restricted as at 343, near bore 336, and also is restricted above and again below lateral passage 342 and these last two restricted areas are provided with a pair of seal ring grooves in which seal rings, such as o-rings 364, are carried. A lateral aperture 365 is provided above upper seal ring 364.

The upper housing member 335 is connected to the upper end of main housing member 360 as by thread 336, as shown. This main housing member has a bore 368 which is enlarged at 370, providing a downwardly facing shoulder 372. A sizeable lateral window 373 is formed in the housing wall as shown having its upper limit coincident with the downwardly facing shoulder 372. A lateral equalizing port 374 is provided in the main housing wall a spaced distance above downwardly facing shoulder 372 and a spaced distance below the lower end of upper housing member 335, as shown.

Main housing member 360 is connected as by thread 375 to skirt member 362, as shown. The skirt member has a central bore 376 which is enlarged as at 378 and then only slightly restricted as at 379 at its lower end.

The skirt member is provided with an external upwardly facing shoulder 380 a spaced distance below thread 375 and the main housing member extends below thread 375 and has its lower end tightened against shoulder 380. Between its lower end and thread 375 the main housing member 360 may be provided with lateral holes 382 which may be covered by suitable filter material 384 carried in a suitable external recess 386 formed in the exterior of the skirt member, as shown. Holes 388 are formed in the skirt 362 at the recess and communicate with holes 382 through filter 384 to filter fluids entering the housing therethrough. Thus sand, debris, and the like are excluded from the test tool.

Above thread 375 and near its upper end the skirt is reduced in outside diameter to provide a shoulder 390. Resting upon the upper end 376 of the skirt is a freely rotatable floating ring 392 having a control pin 393 extending radially inwardly from its wall. A ring cover 394 houses the floating ring and rests upon the upwardly facing shoulder 380 of the skirt member while its internal flange 395*a* provides a suitable end face 395 for the support for main spring 396. The main spring is preloaded to about 40 pounds (18 kilograms) with the valve in closed position seen in FIGS. 7C–7D.

A tubular valve member 400 having a blind bore 402 is mounted in the upper housing member 335 for limited longitudinal movement therein. Bore 402 ends a spaced distance from the upper end of the valve member, thus leaving the upper end portion solid. A cross pin 404 (see FIG. 8) is disposed in a suitable transverse hole 405 formed near the upper end of the valve member and this cross pin has its opposite ends engaged in a pair of opposite longitudinal slots 406 formed in upper housing member 335. A set screw 408 secures cross pin 404 in place. To aid in this, the cross pin may be formed with a suitable recess, such as recess 409.

Intermediate its ends, the valve member is provided with a plurality of long narrow equalizing slots 410 as shown. At its lower end, the valve member is enlarged to provide a valve head 412 which is chamfered at its lower corner to provide a seat surface 414. Just above seat surface 414, an external annular groove is formed to carry a seal ring such as o-ring 416.

A shutter or seal protector 420 surrounds the valve member and has a counterbore 421 at its lower end forming a dependent skirt 422 which is to protect the seal ring 416 in a manner to be explained. The seal protector is also provided with a counterbore at its upper end for receiving a small coil spring 424 which has its upper end abutting the lower end face of upper housing member 335. This spring biases the seal cover 420 and the valve member 400 downward relative to the upper housing member. The load of the small spring approximates about 70 pounds (32 kilograms) with the valve in closed position, seen in FIGS. 7C–7D. It may be desirable to provide one or more longitudinal grooves such as groove 426 formed in the exterior surface of the valve member to permit adequate venting for the chamber 427 seen between the seal cover 420 and the valve-head 412 seen in FIG. 7C.

The mandrel assembly 428 comprises an upper mandrel section 429 and a lower mandrel section 430 connected together by threaded connector 431.

The upper mandrel section 429 is telescoped into the main housing member 355 and is slidable relative thereto. The upper mandrel section 429 is tubular, having a central bore 432, and an enlargement 434 at its upper end which abuts the downwardly facing shoulder 372 as shown. The upper end of bore 432 is enlarged as at 436 providing an upwardly facing inclined seat surface 438 which cooperates with the seat surface 414 of the valve while the seal ring 416 on the valve head is engageable with the wall of enlarged bore 436 of the upper mandrel section to render this valve/seat fluid tight. It may be desirable to flare the enlarged bore 436 at the upper end of the mandrel with about a 30-degree chamfer, as shown, in order to guide the valve into proper alignment with the seat.

The upper mandrel section 429 is provided with an external annular recess 440 a spaced distance below the enlargement 434 at its upper end and a split ring 442 is disposed therein to provide an external flange against the lower side of which the upper end of main spring 396 comes to bear and thus to bias the housing downwardly relative to the mandrel. Between the upper side of the split ring flange and the lower side of mandrel enlargement 434, a recess is provided which carries a bearing ring or bushing 444 for maintaining the upper end of the mandrel centralized in the housing bore 370. The bushing is made of a suitable bearing material such as TEFLON. The TEFLON bushing can be placed in its position before the split ring 442 is installed and, thus, need not be split or scarf cut. Bushing 442 may also serve as a wiper and to exclude solids from the main spring area.

An exterior downwardly facing stop shoulder 445 is formed about the midsection of the upper mandrel section which is engageable by the upper end of seal cover 394 to limit upward movement of the housing relative thereto.

The lower end of the upper mandrel section 429 is secured as by thread 448 to connector 431 and this connection is sealed by a suitable seal ring such as first o-ring 449 suitably carried by one of the mated members, preferably in an internal recess in the connector, as shown.

The lower mandrel section 430 is attached to the lowered end of the connector 431 as by thread 450, and this connection is sealed with a suitable seal ring such as a second o-ring 449.

The connector 431 is relatively close fit within the restricted bore 379 at the lower end of the skirt 362 to guide the lower end of the housing assembly with respect to the mandrel assembly as it is moved longitudinally relative thereto and to exclude solids from the interior of the test tool.

The lower portion of the lower mandrel section 430 is adapted to be anchored in the landing receptacle 100 seen in FIGS. 2A–2B. It is provided with an enlargement 460 providing an upwardly facing anchor shoulder 462 thereabove and a long tapered downwardly facing cam shoulder 463 therebelow. A short distance below enlargement 460, a pair of seal rings such as o-rings 465 is provided, each in a suitable external annular recess. A vent 466 is provided between o-rings 465 to prevent trapping pressure between them. At the lower end of lower mandrel section a nose portion 470 is provided as shown to provide ample guide for guiding the lower end of the test tool into the landing receptacle. The nose portion is slotted as at 472 to provide adequate passage for well fluids and the lower end of the nose portion may be provided with a central opening 474, as desired. It may be preferable to form the nose portion 470 as a separate piece and slip it onto the lower end of the lower mandrel section and secure it thereto by plug welding as indicated by reference numeral 476.

Alternatively, the opening 474 could be enlarged and threaded for attachment of means for sensing and recording pressures and/or temperatures.

It is understandable that the piston 150 of the landing receptacle 100 provides an annular pressure responsive surface having an effective area which is equal to the area of the smooth bore 134 of the housing in which seal ring 157 is sealingly engaged and the area of the smooth bore 152 of the piston in which seal rings 465 of the test tool are sealingly engaged. When the test tool 300 is used with landing receptacle 100 to conduct tests in injection wells, pressures will usually be higher above the piston and the piston will be held thereby in its lowermost position. At this time the test tool is not anchored, and it need not be anchored, since the downwardly acting differential pressure will maintain the test tool in the receptacle. Should the pressures substantially equalize, or should the pressure below the piston exceed that above, the piston will be forced upward by spring 146 and/or the differential pressure acting across the piston's effective area and will cam the anchor lugs inwardly to securely anchor the test tool in the landing receptacle. This last condition, wherein the pressure below the piston exceeds that above it, is the normal condition encountered when test tools are used to conduct tests in producing wells. Thus, the test tool will remain anchored in the landing receptacle until intentionally withdrawn therefrom.

Since the lower cam surface 186 on the anchor lugs is not inclined so acutely as is the cam surface 463 on the lower mandrel section 430, inserting the test tool and anchoring it in the receptacle requires much less force than does withdrawing it therefrom.

The long tapered cam shoulder 463 on the lower mandrel section is not meant to be engageable with the obviously similar corresponding upwardly facing shoulder 153 of the piston 160 of the landing receptacle. These two shoulders are tapered similarly in order to minimize the length of the landing receptacle.

As was explained earlier, the landing receptacle may, by selecting a suitable top sub 124, be used on a variety of locking devices of differing types and even differing manufacturers. Since such locking devices vary in length, the lower mandrel section 430 is provided with adjustment means which makes such utility possible.

The lower mandrel section 430 is provided with a plurality of sets of blind holes, such as blind holes 480, which are spaced apart uniformly (say by one inch or 2.54 centimeters). A sleeve 482 is disposed slidably about the mandrel and is reduced in diameter and externally threaded as at 484 to receive stop collar 485. The sleeve 482 has set screws 486 shown to be engaged in one of the sets of holes 480 to secure the sleeve against displacement. The sleeve 482 has an unthreaded hole 487 spaced above set screw 486 and aligns with the next higher hole 480 as shown. When the unthreaded hole 487 is aligned with a blind hole 480, the set screw 486 also will be aligned with a blind hole 480 of the next lower set of blind holes. Thus the set screws 486 can be readily and promptly aligned with the selected blind holes.

To adjust the lower mandrel section 430 to a locking device/landing receptacle combination, the landing receptacle 100 is attached to the locking device and tightened and the locking device is placed in its locked condition. Set screws 488 of the lower mandrel's stop collar 485 should be loosened and the stop collar raised somewhat by use of thread 484. The lower end of the lower mandrel section is inserted into the locking device and is forced to its fully engaged position. As the long tapered cam shoulder 463 of the mandrel engages the anchor lugs of the landing receptacle, these lugs will be forced outwardly, then when the upwardly facing anchor shoulder 462 has passed the anchor lugs these lugs will be returned to their inner position shown in FIG. 2B. The lower mandrel section is then raised until the upwardly facing anchor shoulder 462 comes to rest against the lugs, after which the sleeve 482 is moved down until the lower end of the stop collar 485 contacts the locking device. The sleeve 482 then is raised until its screw 486 aligns with the nearest set of blind holes 480. The screws 486 are engaged in the proper blind holes 480 and then the stop collar is lowered by operating thread 484 until the stop collar contacts the upper end of the mandrel. The stop collar is then backed up until about 1/6 inch (approximately 1.6 millimeter) play is provided. The screw 488 is tightened to preserve this adjustment which assures that when the lower mandrel section is inserted in the landing receptacle as far as the stop collar will permit, the anchor shoulder will be in position below the anchor lugs and the tapered shoulder 463 of the mandrel will not be engaged with the tapered shoulder 153 of the landing receptacle piston 150.

The stop collar 485 is large in diameter and serves to centralize the lower mandrel section in the well tubing in order to guide the lower end thereof into the open upper end of the locking device. Because it is large in diameter it is provided suitable longitudinal slots such as slots 490 to faciitate its movement through well liquids as the test tool is run into or pulled from a well.

The housing 337 is movable relative to the mandrel assembly 428 by tensioning and relaxing the electrical cable after the test tool has been anchored in the landing receptacle. About 40 pounds (18 kolograms) of weight will be needed to force the housing assembly to its lower position. This presents no problem in the well since the tool string above the test tool normally weighs about 100 pounds (45 kilograms).

When the electrical cable is tensioned, the housing is raised relative to the mandrel. As the mandrel moves upward it does so in opposition to main spring 396 which begins to be compressed and mandrel slot 406 moves upward relative to cross pin 404, and seal rings 364, which normally seal above and below equalizing slots 410 of the valve, move upward relative thereto and soon begin uncovering them. Because the two seal rings 364 seal equal areas the pressure forces acting upon the valve member 400 from above and below are balanced and the valve member can be raised with a minimum of upward pull. When lower seal ring 364 is raised above the lower end of equalizing slots 410, they begin to communicate with equalizing ports 374 in the wall of the upper housing section 335. Flow can then take place between the interior and the exterior of the test tool.

Figure 10:
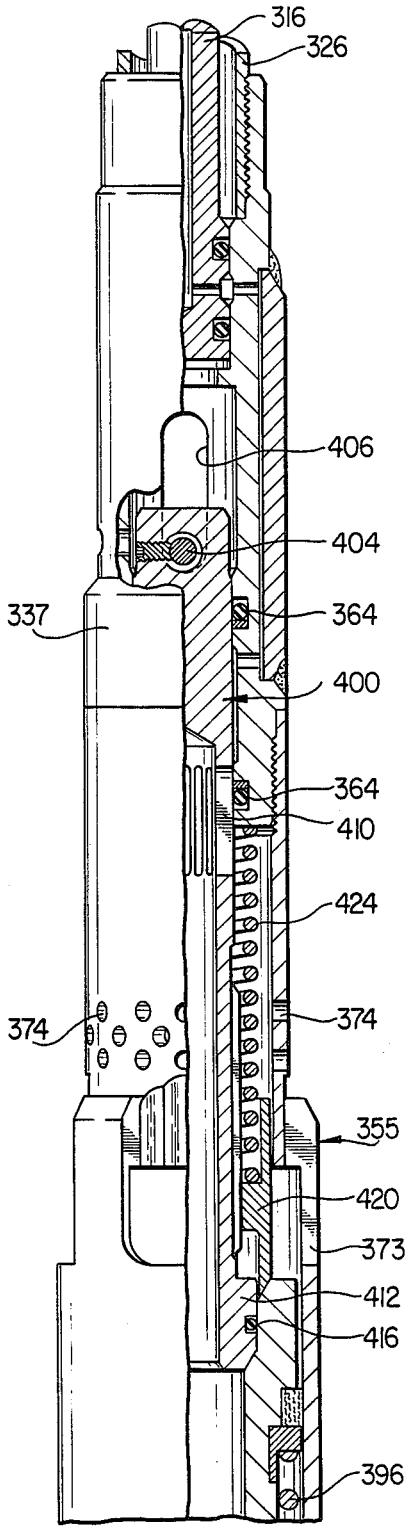
FIG. 10 is a fragmentary longitudinal sectional view showing the test tool of FIGS. 7A–7F with the valve thereof in pressure equalizing position.

Full equalizing position, as seen in FIG. 10, is reached when the lower end of housing slots 406 engage the cross pin 404 at which time the upward pull on the cable will be about 150 pounds (68 kilograms) in excess of pick-up weight. Because the higher pressure from above the valve tends to hold the valve and seal cover in contact with the mandrel, a little greater pull may only stretch the cable until equalization of pressures draws near, at which time the tension in the cable should lift the housing to open position.

Continued upward movement of the housing will cause lifting of the valve member 400 since the lower end of the slot 406 is now engaged with cross pin 404 thereof. As the valve is now lifted with the housing, the valve is lifted relative to the mandrel. At first the valve moves up while the seal cover 420 is held seated in place by the valve spring 424. As the valve is thus lifted, the seal ring 416 on the valvehead 412 moves up in counterbore 436 of the mandrel and the seat surfaces 414 and 438 of the valve and mandrel are separated. Further upward movement of the valve causes the seal ring 416 to move up out of the counterbore 436 of the mandrel and into the open bore 421 of the seal cover 420. While the seal ring 416 is transferred from its confinement in counterbore 436 to the likewise confining bore of the seal cover, the seal cover is pressed tightly against the flared end 437 of the mandrel bore and very little flow, if any, can take place therebetween.

Figure 11:
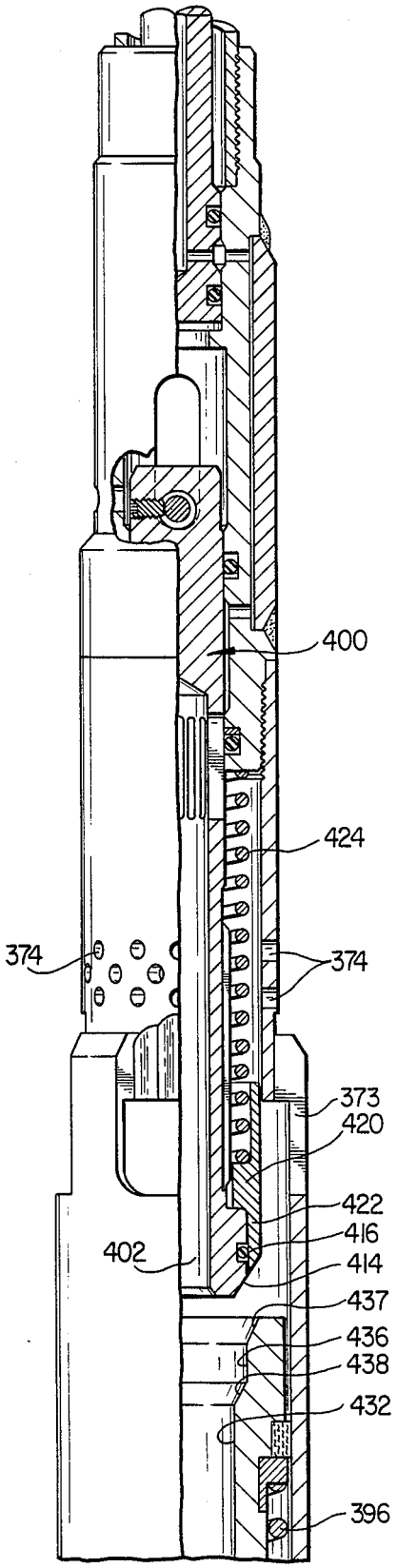
FIG. 11 is a view similar to that of FIG. 10, but showing the test tool with its valve in the open position.

Slacking the electric cable would ordinarily allow the housing to move relatively downward to its lower position with the help of main spring 396 were it not for the means provided on the housing and mandrel for propping or holding them in the open position seen in FIG. 11. This mechanism will now be described.

The control mechanism for releasably holding or propping the housing in its upper position relative to the mandrel principally comprises a slot and pin arrangement. This pin is provided on the freely rotating ring 392 carried in the housing at the upper end of skirt 362 and is indicated by the reference numeral 393. The control slot is formed in the outer surface of the upper mandrel member 429, near its lower end, and is indicated generally by the reference numeral 500. The control slot 500 is shown as a development view in FIG. 9. Similar slot-and-pin arrangements are found in U.S. Pat. Nos. 3,664,427; 4,420,044; 4,583,592; 4,669,537; and 4,678,035.

Figure 9:
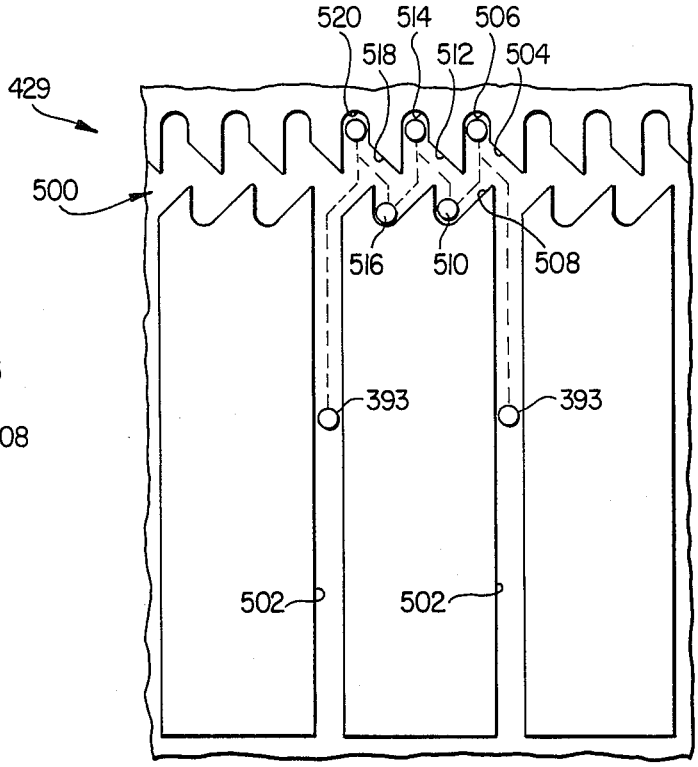
FIG. 9 is a fragmentary development type view showing the control slot of the test tool of FIGS. 7A–7F.

Referring to FIG. 9, the operation of the control slot 500 will be explained using a small circle to indicate the pin 393 engaged in the control slot. It may be desirable to provide say three pins 393 for operating in a control slot such as the control slot 500 having three long legs 502, as shown, to balance the forces acting upon floating ring 392 and thus lend assurance that the floating ring will remain untilted and will rotate freely.

Since the control slot 500 is formed in the wall of the mandrel assembly which is anchored in the landing receptacle, and is, therefore, stationary, the floating ring, being carried in the housing assembly will be raised therewith when the electrical cable is tensioned and will be biased downward by gravity and mainspring 396 when the electrical cable is relaxed.

In the test tool 300, the floating ring 392 is provided with three pins 393 and the control slot 500 is formed with three long legs 502. Since the three pins 393 traverse their three respective portions of the control slot 500 identically, the course of only one of them will be explained. Its course is shown in dashed lines in FIG. 9.

Each long leg 502 runs out at its lower end just above the thread 448 where the diameter of the upper mandrel section has been reduced enabling the floating ring to be slid over the lower end of the upper mandrel section so that its control pins 393 enter the lower ends of the long legs 502 of the slot 500 during assembly of the test tool. This permits the pins to be secured to the ring by a suitable process, such as electron beam welding, which will assure adequate strength.

Figure 7A:
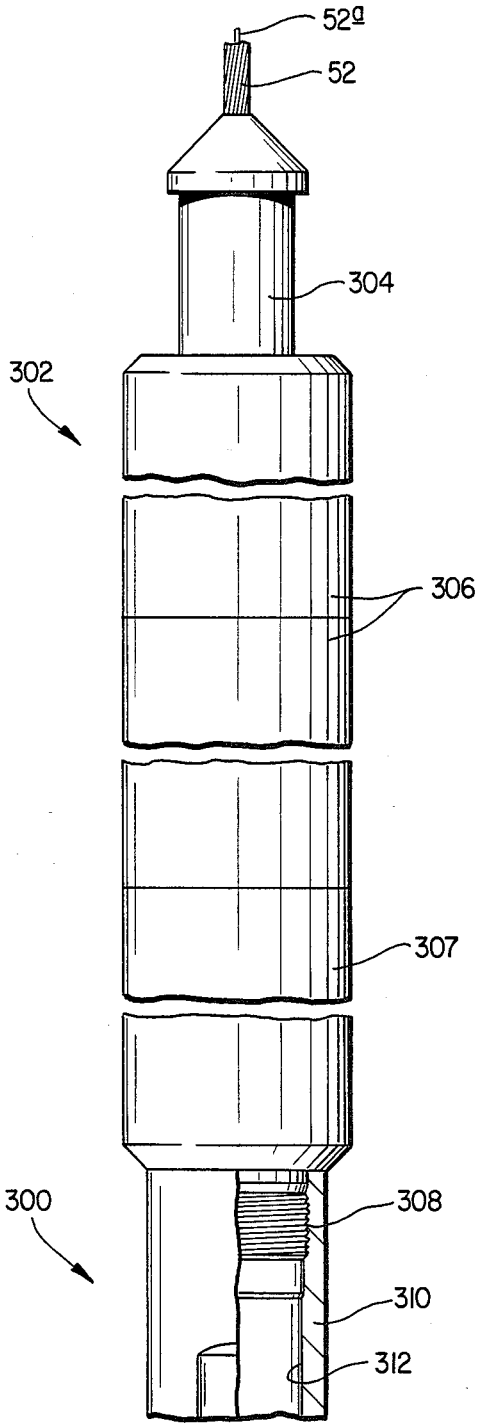
FIGS. 7A, 7B, 7C, 7D, 7E and 7F, taken together, constitute a longitudinal view, partly in section and partly in elevation, showing one embodiment of the test tool of this invention.
Figure 7B:
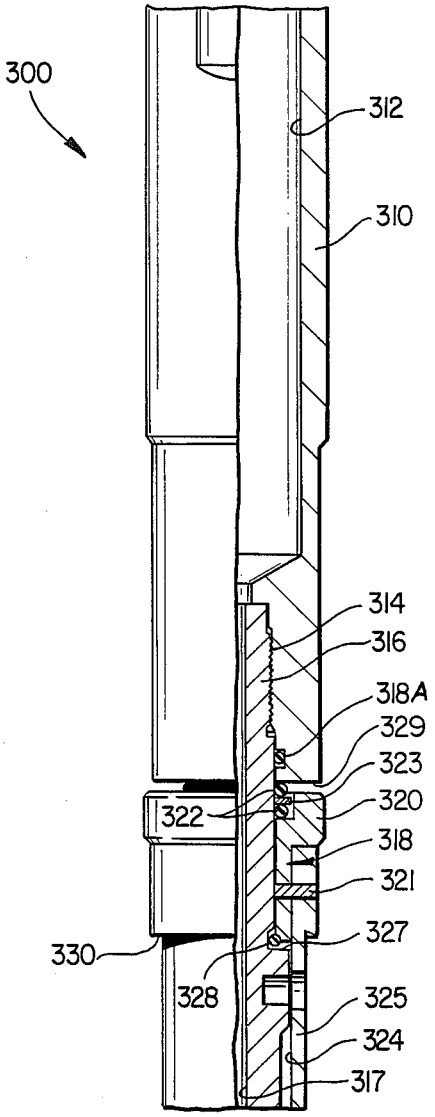
Figure 7C:
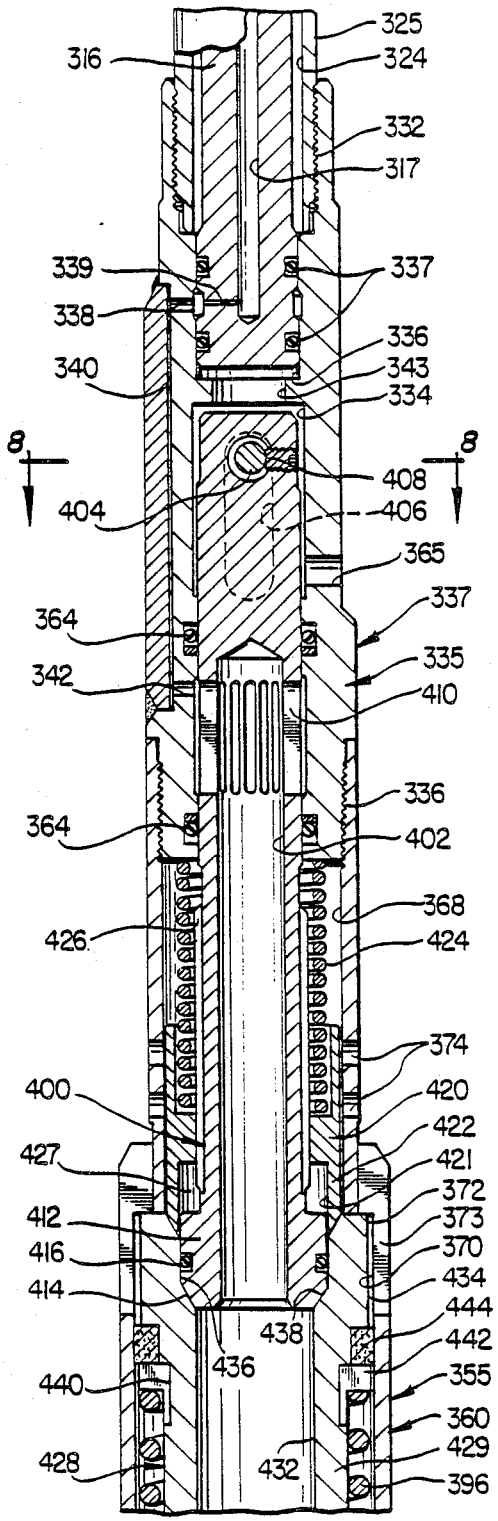
Figure 7D:
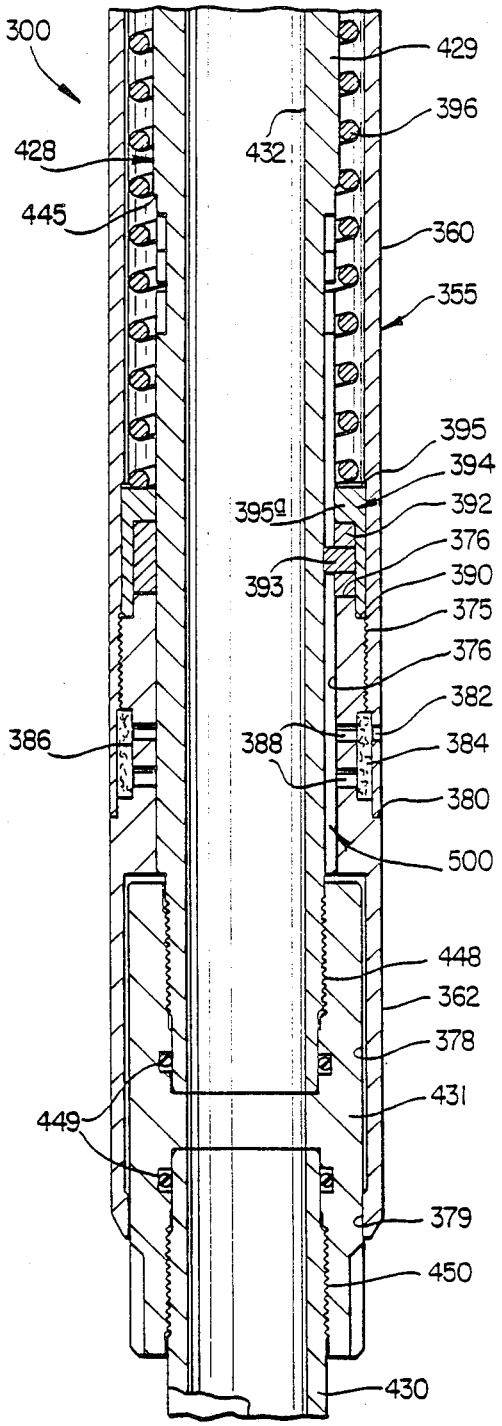
Figure 7E:
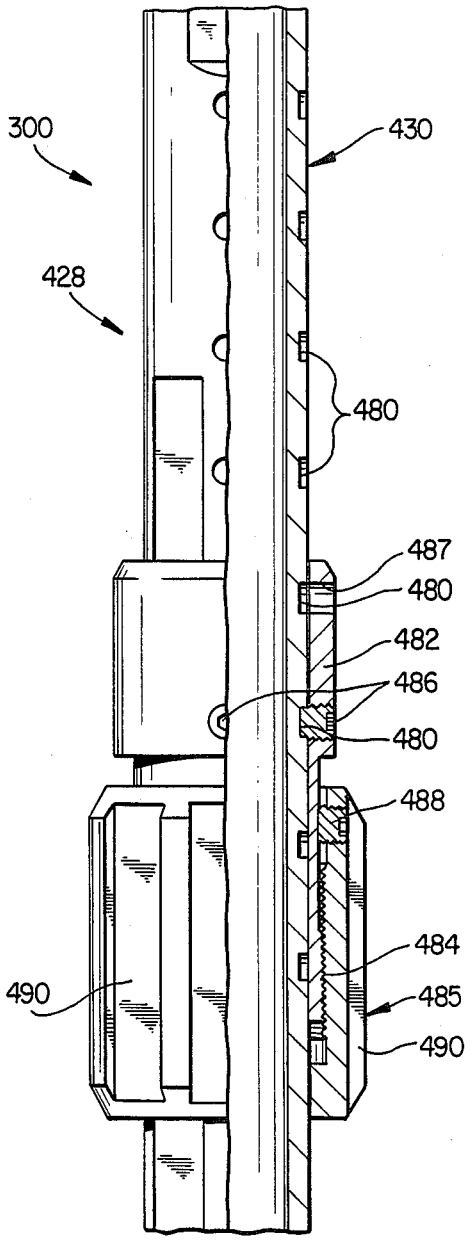
Figure 7F:
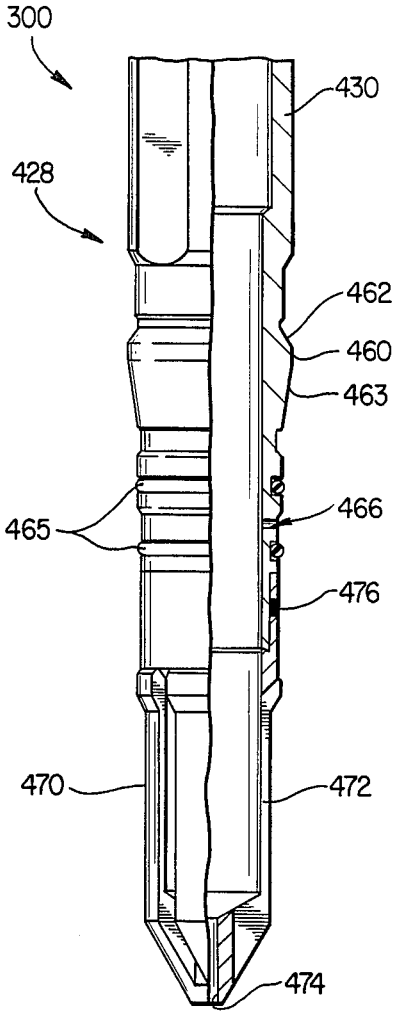

When the housing assembly 337 is in its lower position, as seen in FIGS. 7C–7D, the internal downwardly facing shoulder 372 at the top of window 373 is engaged with the upper end of upper mandrel section 429, as seen in FIG. 7C, the valve is fully closed by virtue of the o-ring 416 on the valve head sealingly engaged in bore 436 of the mandrel and with the seat surfaces 414 and 438 engaged. At this time, the control pin 393 will be positioned as represented in FIG. 9. However, before lowering the test tool into the well, the housing is raised relative to the mandrel so that it will become latched in that position with the valve open. As the housing is raised, the control pin 393 advances upwardly in leg 502 until it engages downwardly facing cam surface 504 which causes the floating ring to rotate while guiding the control pin into short leg 506. The control pin is not stopped by the upper end of the short leg 506 of the control slot, but is stopped because the upward movement of the housing is limited by engagement of the ring cover 394 with external downwardly facing shoulder 445 of the upper mandrel section 429. The housing then cannot be raised further relative to the mandrel. When the housing assembly is allowed to subsequently move down, the control pin moves down and will engage upwardly facing cam surface 508 and will be guided thereby into the upwardly facing pocket 510. The housing is now propped or held against further downward movement and the control pin is positioned correctly for the trip downhole.

After the test tool has been inserted in the landing receptacle, the electrical cable is tensioned at this point to a value about 250 pounds (113 kilograms) in excess of the tension required to lift the cable and tool string, including the test tool, to determine whether or not the test tool is anchored. Too great a pull, of course, will withdraw the test tool from the landing receptacle.

The electric cable then may be slacked as much as desired and the test tool will remain in its thus open position. When the housing assembly is lifted again, the control pin will move upward, engage downwardly facing cam surface 512 and will be guided into short leg 514 of the control slot and stops just short of the upper end thereof as the housing reaches its upper limit of travel. When the housing is again allowed to move down, the control pin will be guided into upwardly facing pocket 516 to again prop or hold the housing assembly against further downward movement on the mandrel. With the housing assembly thus held in its upper position, the test tool is said to be open for not only is the equalizing slot uncovered and able to communicate with the equalizing ports 374 but the valve 400 is held high above the open upper end of the upper mandrel section 425 so that fluid flow may freely take place through the mandrel bore 432 and the window 373. It is at this time that injection operations may be performed and the build-up of pressures below the test tool may be monitored.

At the end of the injection period, the housing assembly is lifted and the control pin 393 moves upward, contacts downwardly facing cam surface 518 and is guided into short leg 520 of the control slot. Now, when the cable is relaxed the housing assembly is lowered, the control pin contacts upwardly facing cam surface 522 and is guided into the next long leg 502. As the electric cable is further relaxed, the housing assembly will return to its lowermost position and control pin 393 will stop in the position shown wherein it occupies the same position as in the beginning but has advanced to the next long leg of the control slot. The valve and equalizing valve are now closed and fall-off pressures below the test tool may be monitored.

Prior to running the test tool 300 into a well, the landing receptacle is run into the well using regular wire line tools including a proper running tool and is installed in the landing nipple preferably located just above the well packer. After the wire line and wireline tools are removed from the well, the test tool 300 and the tool sting 302 are connected together and lowered into the well on an electrical cable until the lower end of the test tool enters the landing receptacle. The test tool is run in the latched open position. As the full weight of the entire tool string is applied, the test tool is forced to its anchored position. The tool string is then raised to confirm that the test tool is anchored in place, and a tension amounting to about 250 pounds (113 kilograms) in excess of the pick-up weight of the tool string and electrical cable is desired, since excessive tension will pull the test tool from the landing receptacle. As the electric cable is then relaxed, the test tool will remain open. Another tension/relax cycle, pulling about 150 pounds (68 kilograms) tension in excess of the pick-up weight, will allow the housing to move to its lower position and the test tool will be fully closed. Thus, once the test tool has been propped in its upper position, the housing must be raised a plurality of times to unprop it for its return to its lower position.

The test tool may be readily lifted from its engagement in the landing receptacle by tensioning the electric cable to about 400 pounds (181 kilograms) in excess of the pick-up weight of the cable, tool string, and test tool. Only a straight upward pull is required. Jarring is neither needed nor desired.

The landing receptacle 100 described hereinabove was removably secured in the well tubing by attaching it to a locking device and then installing the locking device in a landing nipple already in the well tubing. This installation of the landing receptacle was accomplished through use of wireline tools and required one trip for its installation and another trip for its removal. The landing receptacle can be connected into the well tubing to become a portion thereof. See FIGS. 12A and 12B.

Referring now to FIG. 12, it will be seen that the landing receptacle 550 contains all of the structural elements contained in the landing receptacle 100 previously described. The principal difference is that landing receptacle 550 is provided with upper and lower subs which adapt it for connection into a well tubing string to constitute a short section thereof. The upper sub 552 is provided with an upwardly facing stop shoulder 553 and with a box thread 554 while the lower sub 556 is provided with a pin thread. This box-up/pin-down arrangement conforms to general oilfield practice. In addition, the housing 560 of receptacle 550 is much heavier than is the housing of receptacle 100, and understandably so, since it and the upper and lower subs may be subjected to considerable tensile loads. The other parts are the same as the landing receptacle 100 and will receive a test tool such as test tool 300 in anchored and sealed engagement therein in exactly the same manner as described earlier.

When the test tool 300 is to be anchored in a receptacle such as the landing receptacle 550, the stop collar 485 should be adjusted as before explained so that the lower mandrel section 430 will extend into the receptacle sufficiently far to assure that the shoulder 462 of the mandrel is below the anchor lugs but not so far that the long tapered shoulder 463 of the lower mandrel section 430 will contact the long tapered upwardly facing shoulder 153 of the piston.

In operation of the test tool to carry out various tests in an injection well, the test tool is normally run into the well on a tool string attached to the free end of an electrical cable; however, the test tool can be run into the well on a conventional wire line (slick line). If the test tool is run on a slick line, the pressure gage and/or temperature gage run in conjunction therewith must be of the recording type, either battery-powered with an electronic memory, or clock-driven chart and a stylus mechanically writing on the face thereof. The recording instrument can be attached either below or above the test tool.

When an electrical cable such as cable 52 is used, the electrical conductor 52*a* thereof is connected to a suitable electronic transducer means located in the tool string just above the test tool. The transducer means generally will include both pressure and temperature sensor means. Pressure from below the test tool is transmitted, as before explained, through the passage 317 of prong 316 and through the bore 312 of adapter 310 to the transducer section 307 thereabove. The transducer section senses the pressure transmitted thereto and generates electrical signals corresponding to the value of such pressures, which signals are transmitted to the surface through the electrical cable. At the surface, such electrical signals are received by surface equipment which displays and stores them in real time for visual observation at the time and for print out at any time.

In the same manner, a temperature sensor if used generates appropriate temperature signals which are transmitted to the surface in real time for display and/or storing.

The test tool is latched in its open position with control pin 393 in the upwardly facing pocket 510 of control slot 502 and is connected to the lower end of the transducer section fastened to the lower end of the weight section, the electrical cable being attached to the upper end of the weight section through use of a rope socket.

Figure 12A:
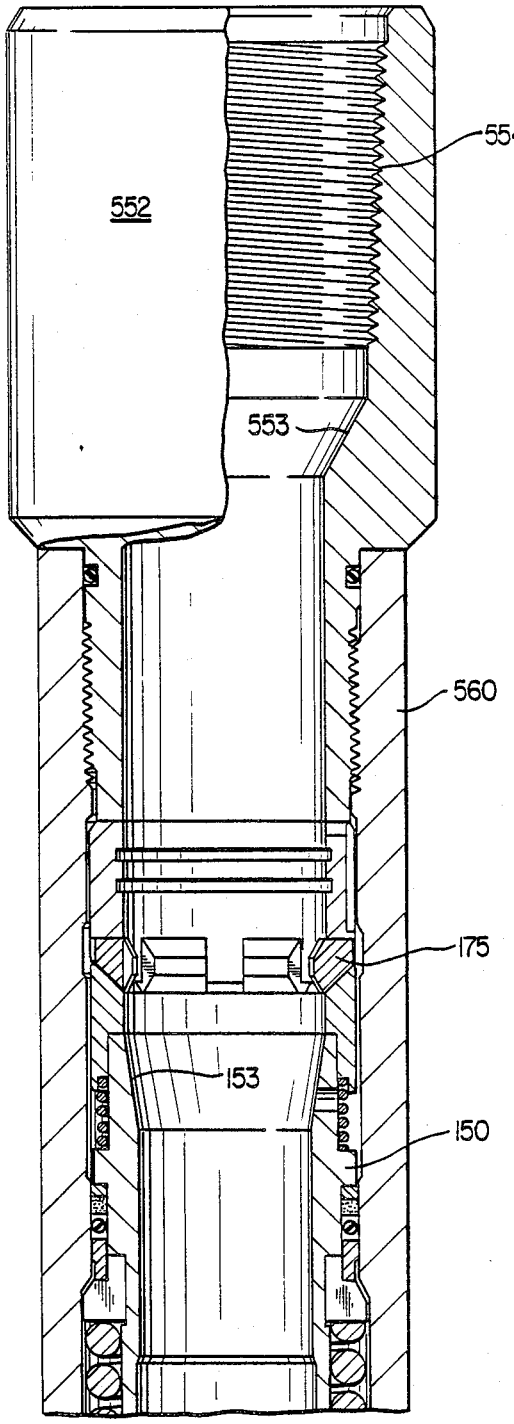
FIG. 12A and 12B together constitute a longitudinal sectional view showing a landing receptacle of this invention for connecting in a well flow conductor to form a portion thereof.
Figure 12B:
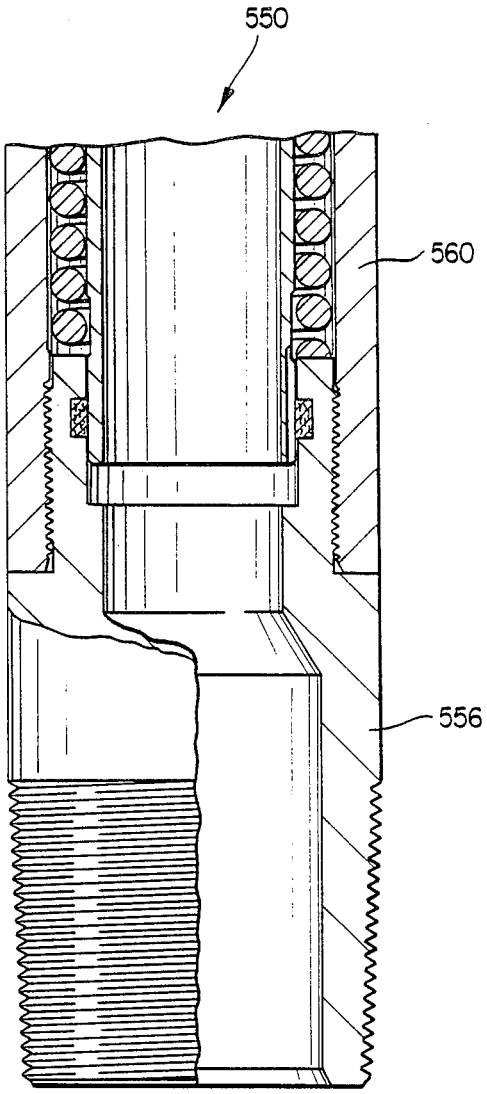

The well tubing must contain a landing receptacle such as landing receptacle 100 of FIGS. 2A–2B or landing receptacle 550 of FIGS. 12A–12B.

The test tool is lowered through the well tubing until the lower end thereof enters the landing receptacle, then the weight of the tool string is used to push the test tool into the receptacle until it becomes fully engaged. The electrical cable is then tensioned to a tensile load about 250 pounds (113 kilograms) in excess of the pick-up weight of the cable, tool string, and test tool. (It is recommended that the descent of the test tool be stopped just before the landing receptacle is reached in order to determine the pick-up weight of the cable and tools.) If, of course, the test tool will be pulled from the receptacle before such a hard pull is reached it is because it is not properly anchored. When pulling such tension, the valve is moved to its open position (FIG. 11) and when the cable is subsequently relaxed the test tool will remain open since control pin 393 has advanced from upwardly facing pocket 510 to upwardly facing pocket 516.

With the test tool thus open, injection of fluids into the well through the tubing and test tool can be accomplished.

When it is desired to close the test tool, the cable is tensioned to about 150 pounds (68 kilograms) in excess of pick-up weight and then relaxed. The control pin is guided from upwardly facing pocket 516 into the long leg 502 of the control slot and the housing moves to its lower position on the mandrel to close the valve. Of course, when the test tool is closed fluids cannot be injected therethrough and the pressure therebelow immediately begins to deminish or fall off as the fluids continue for a time to be dispersed into the earth formation surrounding the well bore. During such time period, the fall-off in pressure is monitored because they are sensed by the pressure transducer and corresponding signals are sent to the surface. In similar manner, when the valve is open, pressures below the test tool are monitored, and when fluids are injected into the well the resulting build up in pressures below the test tool are monitored.

It is important that the cable or slick line can be slacked as much as necessary or desired when the test tool is open or when it is closed, and that the control slot and pin arrangement can be used to hold the housing assembly of this or a similar type of test tool in its upper position on the mandrel regardless of whether the test tool is open or closed when the housing is in its upper position. This is of special importance in testing wells which are located off shore where the surface vessel supporting the reel for the cable or slick line is tossed up and down, to and fro, by waves and wind on the surface of the water.

It can readily be seen that the test tool of this invention can be used to perform tests on wells, such tests including periods of time when the well is shut-in by the closed test tool, and periods when the test tool is open, allowing fluid flow to take place therethrough. As was explained earlier, the test tool may be opened and closed as many times as desired.

A simple test would include running the test tool into a well on a flexible line and anchoring it in the landing receptacle; alternately allowing and prohibiting fluid flow through said test tool by lifting and lowering the housing thereof by tensioning and relaxing the flexible line; slacking the flexible line while leaving the test tool housing in its upper position; and determining well conditions therebelow while the test tool is open and closed.

Other similar methods are performable using various test tools embodying the present invention, in each such method the test tool being held in a condition wherein its housing assembly is in its upper position and the flexible line is slacked off as far as necessary or desired.

Thus, it has been shown that a novel test tool has been provided for testing wells; that the flexible line on which the test tool is lowered into the well can be slacked as much as desired when the tool is open or closed, which makes it ideal for use in testing wells located offshore; that such tool is provided with a improved equalizing mechanism which does not require a large force to operate; that the test tool has a quite large flow capacity; that the increased flow capacity is partly due to an improved landing receptacle for use therewith, the landing receptacle also being provided with anchor lugs which move radially in a plane normal to the axis of the receptacle bore; that the test tool can be run on an electrical line or slick line, and that it can be used with electronic transducer means, or electronic memory gages or mechanical recording gages; that the test tool disclosed in greater detail is ideally suited to testing injection wells; and that the feature relating to the control slot and pin arrangement for propping the test tool housing in its upper position, to permit the flexible line to be slacked as much as desired and which is releasable responsive to a plurality to tension/relax cycles of the flexible line, may be incorporated in other test tools having relatively slidable parts for opening and closing the flow course through the test tool by tensioning and relaxing the flexible line. Further, it has been shown that certain methods of testing wells have been provided by and as a part of the present invention.

The foregoing description and drawings of the invention are explanatory and illustrative only, and various changes in sizes, shapes, and arrangement of parts, as well as certain details of the illustrated construction, may be made within the scope of the appended claims without departing from the true spirit of the invention.

I claim:

1. A test tool for testing a well to be run on a flexible line and anchored in a downhole receptacle having anchor means therein, said test tool being openable and closable by tensioning and relaxing the flexible line to permit and prohibit flow therethrough, said test tool comprising:

(a) tubular mandrel means having a lateral flow port near its upper end and means near its lower end engageable with said anchor means in said receptacle;

(b) tubular housing means having a lateral flow port intermediate its ends, means on its upper end for connection with a flexible line, and having its other end telescoped over the upper end portion of said tubular mandrel means for limited longitudinal movement relative thereto between upper and lower positions responsive to tensioning and relaxing the flexible line while the test tool is anchored in said downhole receptacle for opening and closing said test tool;

(c) means biasing said housing means toward its lower position relative to said mandrel means; and (d) means on said mandrel means and said housing means coengageable for retaining said housing means in its upper position relative to said mandrel means, whereby said flexible line may be slacked when said housing means is retained in such upper position.

2. The test tool of claim 1, wherein said biasing means includes:

(a) means on said mandrel means providing an external downwardly facing shoulder;

(b) means on said housing means providing an internal upwardly facing shoulder; and (c) spring means engaged between said downwardly facing and upwardly facing shoulders for biasing said housing means downward relative to said mandrel means.

3. The test tool of claim 2, wherein said mandrel carries means for sealing engagement with said receptacle, and said mandrel is formed with external shoulder means engageable by said anchor means in said downhole receptacle to anchor said test tool therein.

4. The test tool of claim 3, wherein said means for retaining said housing means in its upper position comprises control slot means on one and pin means on the other of said mandrel means and said housing means coengageable to retain said housing means in its upper position relative to said mandrel means, said control slot means including retaining notch means for supporting said pin means against the compression of said spring means until said pin means is lifted from said retaining notch means a plurality of times.

5. The test tool of claim 4, wherein:

(a) said control slot means is a zig-zag-like groove formed in the exterior surface of said mandrel means, said groove means including retaining notches and release groove means; and (b) said pin projects inwardly from a ring rotatably carried in an internal annular recess in said housing means, said pin having its inner end engaged in said control slot means.

6. The test tool of claim 5, wherein said housing means is connectable at its upper end to pressure sensing means lowerable into a well on an electrical cable, and said test tool is provided with a flow passage for conducting well pressure from therebelow to said pressure sensing means thereabove all the while said test tool is in the well.

7. The test tool of claim 1, 2, 3, 4, 5, or 6, wherein when said housing means is in its upper position the lateral flow port of the mandrel means and the lateral flow port of the housing means are in communication and fluid flow through the test tool is permitted, and when said housing means is in its lower position said lateral flow ports of said housing means and mandrel means are not in communication and flow through the test tool is prohibited.

8. The test tool of claim 7 in combination with a downhole receptacle, comprising:

(a) tubular receptacle housing means having means on at least one end thereof for securing the same in a well flow conductor, said tubular receptacle housing means having downwardly facing shoulder means, upwardly facing shoulder means, and a smooth bore portion therebetween, said downwardly facing shoulder means having a plurality of radially spaced downwardly opening recesses, each providing a downwardly facing planar surface which is in a plane substantially normal to the longitudinal axis of the tubular receptacle housing means;

(b) an anchor lug in each of said downwardly opening recesses and movable radially therein between an inner position for anchoring engagement with said anchor means of said mandrel means and an outer position for releasing said test tool;

(c) tubular piston means mounted for longitudinal sliding movement in said tubular receptacle housing means between upper and lower positions and having an annular cam surface formed thereon which is inclined upwardly and outwardly for camming said anchor lugs inwardly upon upward movement of said tubular piston means, said piston having a smooth bore portion for sealing engagement with said seal means on said tubular mandrel means;

(d) means sealing between said tubular piston means and said smooth bore portion of said tubular housing means; and (e) means biasing said piston means toward its upper position.

9. A landing receptacle for anchoring a well tool in a well, comprising:

(a) tubular housing means having means on at least one end thereof for securing the same in a well flow conductor, said tubular housing means having downwardly facing shoulder means, upwardly facing shoulder means, and a smooth bore portion therebetween, said downwardly facing shoulder means having a plurality of radially spaced downwardly opening recesses, each providing a downwardly facing planar surface which is in a plane substantially normal to the longitudinal axis of the tubular housing means;

(b) an anchor lug in each of said downwardly opening recesses and movable radially therein between an inner position for anchoring engagement with said anchor means of said mandrel means and an outer position for releasing said test tool;

(c) tubular piston means mounted for longitudinal sliding movement in said tubular receptacle housing means between upper and lower positions and having an annular cam surface formed thereon which is inclined upwardly and outwardly for camming said anchor lugs inwardly upon upward movement of said tubular piston means, said piston having a smooth bore portion for sealing engagement with said seal means on said well tool;

(d) means sealing between said tubular piston means and said smooth bore portion of said tubular housing means; and (e) mean biasing said piston means toward its upper position.

10. The landing receptacle of claim 9, wherein said tubular housing means thereof is provided with thread means at its upper end for attachment to a suitable locking device which is removably installable in a landing nipple which forms a part of a well flow conductor.

11. The landing receptacle of claim 9, wherein said tubular housing means thereof is provided with thread means at its opposite ends for attachment in a well flow conductor to become a part thereof.

12. A test tool for testing a well to be run on a flexible line and anchored in a downhole receptacle having anchor means therein, said test tool being openable and closable by tensioning and relaxing the flexible line to permit and prohibit flow therethrough, said test tool comprising:

(a) tubular mandrel means having a bore, a valve seat surrounding said bore, an external flange near its upper end, and means near its lower end for engagement with said anchor means in said downhole receptacle;

(b) tubular housing means having a downwardly facing internal stop shoulder intermediate its ends with a flow port therebelow and an equalizing port thereabove, said tubular housing means having means on its upper end for connection with a flexible line, and having its other end telescoped over the upper end portion of said tubular mandrel means for limited longitudinal movement relative thereto between upper, intermediate and lower positions responsive to tensioning and relaxing the flexible line while the test tool is anchored in said downhole receptacle for opening and closing said test tool;

(c) tubular mandrel extension means mounted in said tubular housing means for limited longitudinal movement therein and having a flow port intermediate its ends, and a valve surface formed on its lower end engageable with said seat surface on said tubular mandrel means for preventing flow between such valve and seat surfaces;

(d) means limiting relative movement between said tubular housing means and said mandrel extension means, whereby when said tubular housing means is moved from its lower to its intermediate position relative to said tubular mandrel means the lateral port of said mandrel extension means will communicate with said equalizing ports of said tubular housing to permit pressures to substantially equalize across the test tool, and when said tubular housing means is moved from its intermediate position to its upper position said mandrel extension means will be lifted from its engagement with the seat surface in said tubular mandrel means to thus communicate the upper open end of the tubular mandrel means with the lateral flow port of said tubular housing means, thus opening the test tool fully;

(e) means sealing between said tubular mandrel extension and said tubular housing means normally preventing fluid communication between said lateral flow port of said mandrel extension means and said equalizing port of said tubular housing means;

(f) means biasing said tubular housing means towards said lower position; and (g) means on said tubular mandrel means and said tubular housing means coengageable to retain said tubular housing means in its upper position to permit the flexible line to be slacked while the test tool remains open.

13. The test tool of claim 12, wherein said tubular housing means is formed with a longitudinally extending slot in its wall, said mandrel extension means is formed with a transverse aperture therethrough, and a cross-pin is installed in said aperture of said mandrel extension means and has a portion thereof engaged in said slot of said tubular housing means to limit relative movement between said housing means and said mandrel extension means.

14. The device of claim 13, wherein said mandrel means is formed with a counterbore above said seat surface in said tubular mandrel means, said tubular mandrel extension is provided with a resilient seal ring carried in a suitable recess for sealing engagement in said counterbore, and a shutter is provided to protect said seal ring as it is transferred from said counterbore to said shutter and back again as the mandrel extension means moves longitudinally relative to the housing means during opening and closing of the test tool, and biasing means is provided for biasing the shutter toward seal ring covering position.

15. The test tool of claim 14, wherein said means for retaining said housing means in its upper position relative to said mandrel means comprises control slot means on one and pin means on the other of said mandrel means and housing means coengageable to retain said housing means in its upper position relative to said mandrel means, said control slot means including notch means for retaining said pin means against the compression of said spring means until said pin means is lifted from said notch means a plurality of times.

16. The test tool of claim 15, wherein:

(a) said control slot means is a zig-zag-like groove formed in the exterior surface of said mandrel means, said groove including retaining notches and release groove means; and (b) said pin projects inwardly from a ring rotatably carried in an internal annular recess in said housing means, said pin having its inner end engaged in said control slot means.

17. The test tool of claim 16, wherein said flexible line is an electrical cable and pressure sensing means is connectable therewith, and said test tool is provided with a flow passage for conducting well pressure from therebelow to said pressure sensing means thereabove all the while said test tool is anchored in the downhole receptacle.

18. Claim 12, 13, 14, 15, 16, or 17 in combination with a downhole receptacle, comprising:

(a) tubular housing means having means on at least one end thereof for securing the same in a well flow conductor, said tubular housing means having downwardly facing shoulder means, upwardly facing shoulder means, and a smooth bore portion therebetween, said downwardly facing shoulder means having a plurality of radially spaced downwardly opening recesses, each providing a downwardly facing planar surface which is in a plane substantially normal to the longitudinal axis of the tubular housing means;

(b) an anchor lug in each of said downwardly opening recesses and movable radially therein between an inner position for anchoring engagement with said anchor means of said mandrel means and an outer position for releasing said test tool;

(c) tubular piston means mounted for longitudinal sliding movement in said housing between upper and lower positions and having an annular cam surface formed thereon which is inclined upwardly and outwardly for camming said anchor lugs inwardly upon upward movement of said tubular piston means, said piston having a smooth bore portion for sealing engagement with said seal means on said tubular mandrel means;

(d) means sealing between said tubular piston means and said smooth bore portion of said tubular housing means; and (e) means biasing said piston means toward its upper position.

19. The method of testing a well having a tubing with a landing receptacle and a test tool therein, said test tool including a valve which is operable between open and closed positions by raising and lowering the upper portion of said test tool relative to the lower portion thereof, said method comprising the steps of:

(a) running the test tool into the tubing on a flexible line and landing it in the landing receptacle;

(b) alternately flowing and shutting-in the well by raising and lowering the upper portion of the test tool while the lower portion thereof is engaged in said landing receptacle;

(c) slacking the flexible line after the upper portion of the test tool has been raised to actuate the valve to retain said upper portion of said test tool in raised position; and (d) determining well conditions while the well is shut-in and flowing.

20. The method of claim 19, wherein prior to withdrawing said test tool from said landing receptacle, the well is shut-in at the surface and the valve is opened to equalize pressures thereacross.

21. The method of claim 19, wherein said valve is open when the upper portion of said test tool is in its upper position relative to the lower portion thereof.

22. The method of claim 19, wherein said valve is open when the upper portion of said test tool is in its lower position relative to the lower portion thereof.

23. The method of claim 19, 20, 21, or 22, wherein the test tool is operatively connected with a transducer and to an electrical cable, and well conditions are monitored continuously while said test tool is landed in said landing receptacle.

* * * * *